US008510915B2

(12) United States Patent
Daniels et al.

(10) Patent No.: US 8,510,915 B2
(45) Date of Patent: Aug. 20, 2013

(54) REMOVABLE PULL FASCIA

(75) Inventors: James L. Daniels, Stokesdale, NC (US); Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 588 days.

(21) Appl. No.: 12/395,753

(22) Filed: Mar. 2, 2009

(65) Prior Publication Data

US 2010/0218346 A1 Sep. 2, 2010

(51) Int. Cl.
*A47B 95/02* (2006.01)

(52) U.S. Cl.
USPC ..... 16/417

(58) Field of Classification Search
USPC ..... 16/417, 414, 433, 441; 411/349, 411/549–553; 24/663; 403/348–349
See application file for complete search history.

(56) References Cited

U.S. PATENT DOCUMENTS

| | | | | |
|---|---|---|---|---|
| 574,399 | A * | 1/1897 | Dawes | 40/325 |
| 4,088,361 | A * | 5/1978 | Ditcher | 294/89 |
| 5,499,427 | A * | 3/1996 | Bowman | 16/417 |
| 5,545,167 | A * | 8/1996 | Lin | 606/278 |
| 6,092,849 | A * | 7/2000 | Zambelli et al. | 294/89 |
| 6,108,944 | A * | 8/2000 | Savoie | 36/134 |
| 6,528,001 | B1 * | 3/2003 | Howie, Jr. | 264/273 |
| 6,842,946 | B2 * | 1/2005 | Hayden | 16/414 |
| 7,118,138 | B1 * | 10/2006 | Rowley et al. | 285/332.2 |
| 2004/0078933 | A1 * | 4/2004 | Forrest | 16/417 |
| 2009/0079311 | A1 * | 3/2009 | Lai | 312/332.1 |
| 2010/0272540 | A1 * | 10/2010 | Bucker et al. | 411/549 |

* cited by examiner

*Primary Examiner* — Victor Batson
*Assistant Examiner* — Matthew Sullivan
(74) *Attorney, Agent, or Firm* — Carlson, Gaskey & Olds, P.C.

(57) ABSTRACT

A pull assembly has a knob and a detachable fascia. An insert is located inside the knob, and the fascia attaches to the insert. The insert has a keyed hole, into which a tab extending from a non-decorative face of the fascia is inserted. The fascia may be rotated between a locked position and an unlocked position. When the fascia is rotated into the unlocked position, the fascia can be detached, and when the fascia is in the locked position, the fascia cannot be detached.

15 Claims, 3 Drawing Sheets

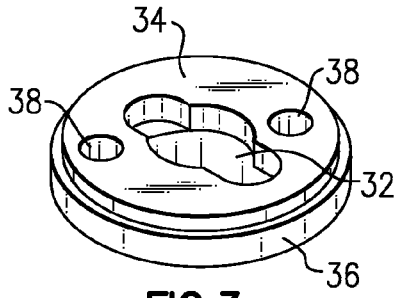
FIG.3
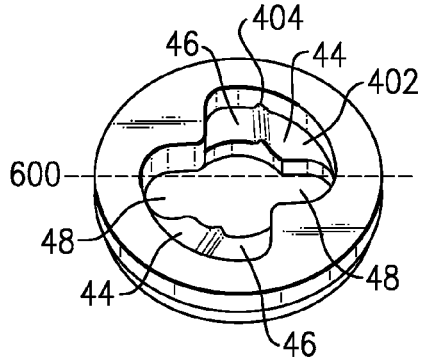
FIG.4A
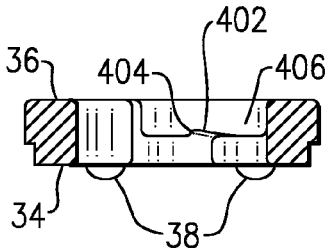
FIG.4B
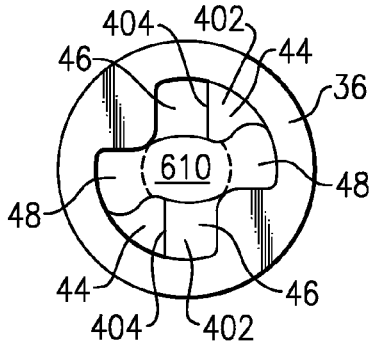
FIG.4C
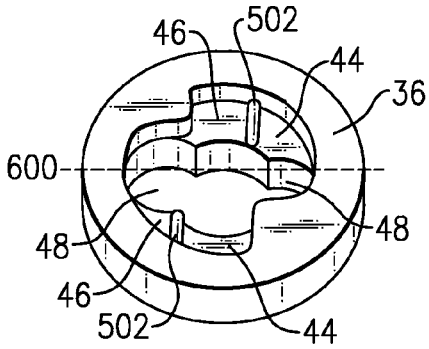
FIG.5A
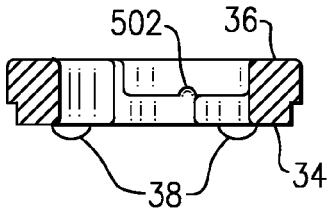
FIG.5B
FIG.5C
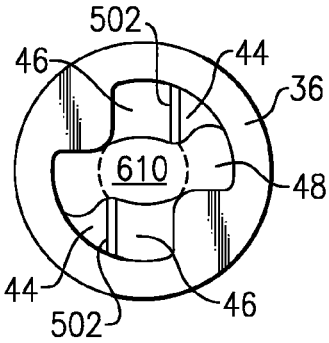

REMOVABLE PULL FASCIA

BACKGROUND OF THE INVENTION

The present disclosure is directed towards an apparatus for attaching and detaching decorative fascias to pulls for opening drawers.

Pulls for opening drawers and doors may include knobs and handles. Kitchens, bathrooms, and other environments often include pulls for opening and closing cabinet doors, drawers, or the like.

Pulls can aesthetically enhance the surrounding environments. As an example, some decorative pulls include intricate details and accents. Such decorative pulls are especially common in household environments. Incorporating more decorative pulls into a new kitchen design enhances or changes the new kitchen's aesthetic appeal, for example. Similarly, replacing pulls in an existing kitchen with newer pulls can update the look of the kitchen, the kitchen's theme, or otherwise change the kitchen aesthetics.

Pulls typically secure to doors or drawer faces with one or more screws. In such an arrangement, a screw is typically extended through a door or drawer face and the knob is screwed onto the screw while the head of the screw is held stationary. Once attached, the screw and the knob will turn together unless the object not being turned is held stationary. Consequently, removing the knob from the door requires a person to hold either the knob or the screw stationary while turning the other the appropriate direction. Therefore, replacing entire pulls is expensive and often requires tools for removing the screws.

SUMMARY OF THE INVENTION

Disclosed is a pull assembly having a knob and a fascia. The fascia has a first and a second face. One of the knob and the fascia has a key tab and the other has a keyed hole. The tab and the keyed hole are removably interlockable.

These and other features of the present invention can be best understood from the following specification and drawings, the following of which is a brief description.

BRIEF DESCRIPTION OF THE DRAWINGS

FIG. 3 shows an isometric view of an example insert.

FIG. 4A shows an isometric view of an example insert.

FIG. 4B shows a bisected side view of the example insert of FIG. 4A.

FIG. 4C shows a view of an inner surface of the example insert of FIG. 4A.

FIG. 5A shows an isometric view of an example insert.

FIG. 5B shows a bisected side view of the example insert of FIG. 5A.

FIG. 5C shows a view of an inner surface of the example insert of FIG. 5A.

DETAILED DESCRIPTION OF THE PREFERRED EMBODIMENT

An example structure, such as a cabinet or a dresser, will typically have doors or drawers which are flush with the structure when closed. To facilitate opening and closing the doors or drawers a pull is typically used.

Figure 1:
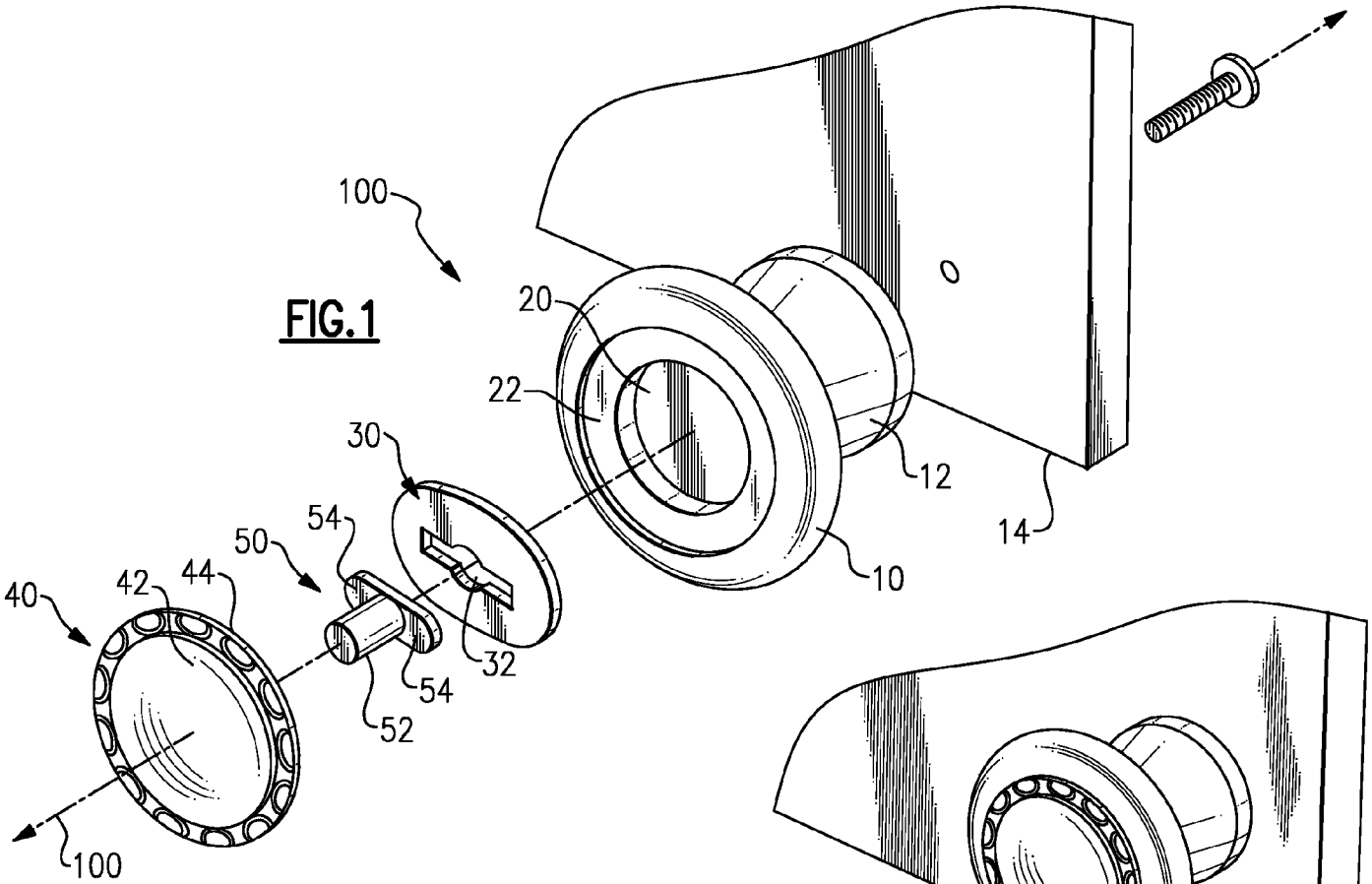
FIG. 1 shows an exploded view of an example pull assembly.

FIG. 1 illustrates an example pull assembly 100 which has a knob 10 which has a base 12, a first recess 20, and a second recess 22. An insert 30 is inserted into the first recess 20 where it is held in place using an adhesive, a frictional fit, threading, a snap-lock rib, or any other known method. The insert 30 additionally has a keyed hole 32. Attached to the knob 10, through the keyed hole 32 in the insert 30, is a fascia 40. The fascia 40 has a decorative face 42 which faces away from the knob 10 and a non-decorative face 45 which faces toward the knob 10 once the fascia 40 is attached. Once the knob 10 has been fully assembled, it is attached to a structure 14 door or drawer. The structure 14 can be a cabinet, a dresser, or any other similar structure having drawers or doors.

The fascia 40 also has a tab 50 protruding from the non-decorative face 45 along an axis 100 defined by the knob 10. The tab 50 includes a post 52 affixed to the non-decorative face 45 of the fascia 40. The tab 50 also includes wings 54 protruding radially away from the post 52. Each of the wings 54 has at least a component which is perpendicular to the post 52. The wings 54 are located on an end of the post 52 opposite the fascia 40. The keyed hole 32 and the tab 50 have similar profiles, such that the tab 50 may be inserted into the keyed hole 32 when the fascia 40 is oriented in a first position, and may not be inserted or removed from the keyed hole 32 when the fascia is oriented in a second position. While the tab 50 and the keyed hole 32 are shown having a profile with a post 52 and two wings 54, it is known that alternate profile configurations could be utilized and function with the disclosure.

Figure 2:
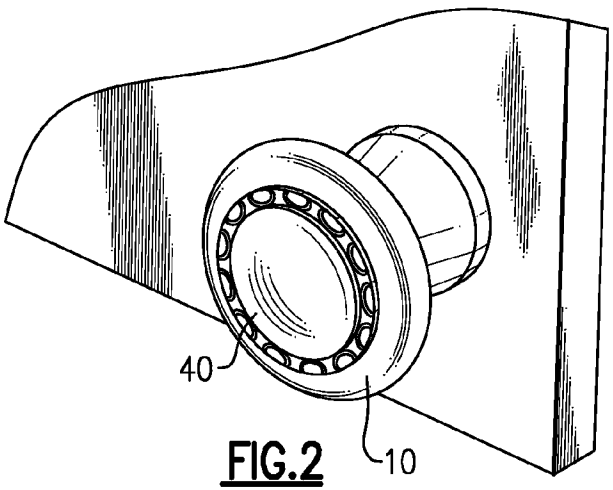
FIG. 2 shows a view of the FIG. 1 pull assembly in an installed position.

FIG. 2 illustrates an assembled pull. The fascia 40, of the assembled pull, rests in the second recess 22. When the decorative fascia 40 is inserted into the knob 10 and is rotated into the second position, the keyed hole 32 in the insert 30 prevents the fascia 40 from being removed. When the fascia 40 is in the first position the tab 50 profile will be aligned with the keyed hole 32 profile on the outer surface 34 of the insert 30, thus allowing the decorative fascia 40 to be removed. When the decorative fascia 40 is removed, it is also possible to remove and replace the insert 30.

Referring now to FIG. 3, an example insert 30 is shown. The insert contains the keyed hole 32, portions of which extend from an outer surface 34 to an inner surface 36. The insert 30 is inserted into the first recess 20 of the knob 10 (FIG. 1). Once inserted, the outer surface 34 of the insert 30 faces away from the base 12 of the knob 10, and the inner surface 36 of the insert faces toward the base 12 of the knob 10. The outer surface 34 can also have a set of bumps 38 which act to push the fascia 40 away from the knob 10 when the fascia is in the first position. These bumps 38 aid in the removal of the fascia 40 by preventing the fascia 40 from remaining flush with the knob 10 while the fascia is in the first position. The Illustration of FIG. 3 can be any of the example inserts illustrated in FIGS. 4-6.

Each of the example inserts of FIGS. 4A-C, 5A-C, and 6A-C operate in fundamentally the same manner, having a set of first notch regions 48, a set of second notch regions 46, and overlapping regions 44. Reference is made in the following section to FIGS. 6A, 6B, and 6C, however the examples of Figure sets 4A-C and 5A-C operate similarly, with like numerals indicating functionally equivalent components or regions, and with the differences being discussed in the sections headed "The example of FIGS. 4A, 4B, and 4C" and headed "The example of FIGS. 5A, 5B, and 5C."

Figure 6A:
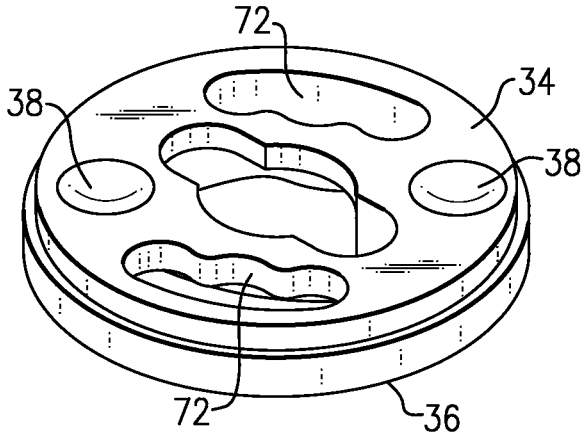
FIG. 6A shows an isometric view of an example insert.
Figure 6B:
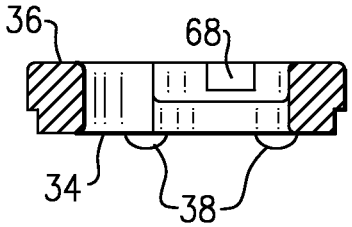
FIG. 6B shows a bisected side view of the example insert of FIG. 6A.
Figure 6C:
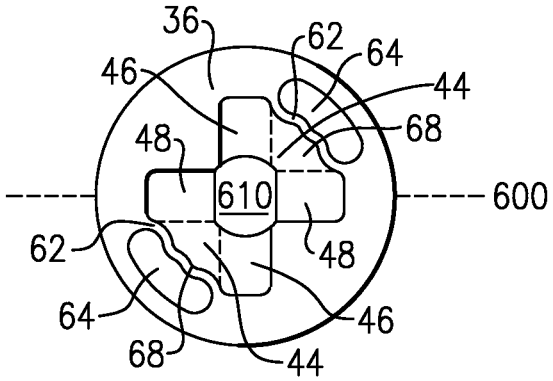
FIG. 6C shows a view of an inner surface of the example insert of FIG. 6A.

FIGS. 6A, 6B, and 6C illustrate an example insert 30 for use with the pull knob assembly of FIG. 1. FIG. 6A illustrates an isometric view of the insert 30 showing the outer surface 34. FIG. 6B illustrates a cut out side view of the insert 30 which is cut along the line 600. FIG. 6C illustrates a view of the inner surface 36 of the insert 30. FIGS. 4A-C and 5A-C show corresponding views of the example inserts represented (i.e. FIGS. 4A, 5A, and 6A are corresponding views of the respective example inserts 30).

In FIG. 6C, the keyed hole 32 is divided into regions, defined in the drawings using dashed lines. The keyed hole 32 has a set of first notch regions 48, a set of second notch regions 46, and a set of overlapping regions 44. Each overlapping region 44 defines a boundary between a first notch region 48 and a second notch region 46. The keyed hole 32 additionally has a post region 610.

The post region 610 and the set of first notch regions 48 extend through the insert 30 to the outer surface 34. The overlapping region 44 and the set of second notch regions 46 extend from the inner surface 34 only partially into the insert 30. Since the second notch regions 46, and the overlapping regions 44 extend only partially through the insert 30, a physical barrier exists within the keyed hole 32. The physical barrier prevents removal of the fascia 40 when the tab 50 is inserted and rotated such that the wings 54 of the tab 50 are in either the set of second notch regions 46 or the overlapping regions 44. When the wings 54 are in the second notch regions 46 (i.e. the second position), the fascia 40 is referred to as being in a locked position. Conversely, the fascia 40 is referred to as being in an unlocked position when the wings 54 are in the first notch region 48 (i.e. the first position).

Each of the examples corresponding to the Figure sets 4, 5, and 6 have differing locking mechanisms for securing the fascia 40 in the locked position when no force is being applied. The locking mechanisms for each example insert are described below with reference to the applicable figures.

The example of FIGS. 4A, 4B, and 4C uses a ramp 402 in each of the overlapping regions 44 to facilitate locking the fascia 40 in the locked position. The ramp 402 has a surface which slopes from the second notch region 46 to the first notch region 48. In order to form the ramp 402, the keyed hole 32 does not extend as far into the insert 30 on a ramp edge 404 bordering the second notch region 46, as it does on a ramp edge 406 bordering the first notch region 48. This forms a sloping surface of the ramp 402. The second notch region 46 of the keyed hole 32 additionally extends further into the insert 30 than the ramp edge 404 bordering the second notch region 46. The extra depth of the second notch region 46, relative to the ramp edge 404, allows the fascia 40 to be held in the locked position until a user applies rotational force to remove the fascia 40, due to the wings 54 resting in the second notch regions 46 and abutting the ramp edge 404.

In order to insert the fascia 40 in the example of FIGS. 4A, 4B, and 4C, the tab 50 is inserted from the outer surface 34 with the wings 54 of the tab 50 aligned with the first notch regions 48. Once the tab 50 is fully inserted and the fascia 40 is flush with the knob 10, the fascia 40 is rotated such that the wings 54 pass over the ramp 402 through the overlapping region 44 of the first and second notch regions 46, 48. Once the wings 54 are fully rotated into the second notch region 46, the ramp edge 404 defining the border between the overlapping region 44 and the second notch 46 holds the wings in place until they are rotated out. Additionally the insert 30 prevents the fascia 40 from being removed when in the locked position, because the second notch region 46 does not extend through the insert 30 to the outer surface 34.

The example of FIGS. 5A, 5B, and 5C illustrate another example insert 30 and use a ridge 502 between the overlapping region 44 and the second notch region 46, which prevents the fascia 40 from rotating into the unlocked position without additional force being applied. The ridges 502 are between the second notch regions 46 and the overlapping regions 44, and define a border between the regions. The ridges 502 are constructed of a portion of the keyed hole 32 which does not extend as far into the insert 30 as the second notched regions 46 or the overlapping regions 44.

When the fascia 40 is initially inserted into the insert 30 in the first position the wings 54 of the tab 50 cannot pass over the ridge 502 without additional rotational force being applied. When a person applies rotational force to the fascia 40 the wings 54 can pass over the ridge 502 thereby allowing the user to rotate the fascia 40 between the locked position and the unlocked position. The example of FIGS. 5A, 5B, and 5C can be additionally effective if the bumps 38 described above are utilized. Inclusion of the bumps 38 on the outer surface 34 requires a user to apply force along the axis defined by the knob 10 as well as rotational force in order for the wings to pass over the ridges 502.

The example of FIGS. 6A, 6B, and 6C uses a spring mechanism to prevent the fascia 40 from being rotated without additional force being applied. Initially bordering the overlapping region 44 in FIGS. 6A, 6B, and 6C, is a flexible spring wall 62. The flexible spring wall 62 has a gap 64 between itself and the outer surface 34 of the insert 30. The gap 64 allows the flexible spring wall 62 to be forced away from the post region 610 as the wings 54 of the tab 50 pass through the overlapping region 44. Once the wings 54 have entered the second notch region 46, the flexible spring wall 62 springs back to its natural position. A second gap 72 exists in the barrier portion of the insert 30 from a side of the flexible spring wall 62 closest to the outer surface 34 of the insert 30 extending to the outer surface 34. The second gap 72 allows the flexible spring wall 62 to flex independently of the remainder of the insert 30.

The flexible spring wall 62 additionally has a center portion 68 which protrudes partially into the overlapping region 44. The protrusion 68 prevents the wings 54 of the tab 50 from moving out of the first notch 48 or out of the second notch 46 without rotational force being applied. The flexible spring wall 62 thereby holds the tab 50 in place in either the locked position or the unlocked position once the tab 50 has been rotated into one of the positions.

While each of the examples illustrated above illustrate a keyed hole 32 in the insert 30, it is understood that the keyed hole 32 could be in the fascia 40 with the tab 50 in the insert 30, and still fall within the above disclosure.

Although example embodiments of this invention have been disclosed, a worker of ordinary skill in this art would recognize that certain modifications would come within the scope of this invention. For that reason, the following claims should be studied to determine the true scope and content of this invention.

What is claimed is:

1. A pull assembly comprising;

a knob having a first recess set within a second recess, said first recess and said second recess being located on an end of said knob;

an insert attachable to said knob, wherein said insert is at least partially within said first recess; and a fascia having a first face and a second face and said insert comprising a keyed hole, and said fascia comprising a key tab that is removably interlockable with said keyed hole, wherein said keyed hole has a central circular portion extending an axial length of the keyed hole, a first notch region protruding radially away from said central circular portion, and extending a full axial length of said keyed hole along the central circular portion, a second notch region protruding radially away from said central circular portion, and extending less than 100% of the axial length of the keyed hole along the central portion.

2. The pull assembly of claim 1, wherein said keyed hole has an overlapping region bordering said first notch region and said second notch region, wherein said overlapping region extends less than an entire axial length of said keyed hole along the central portion.

3. The pull assembly of claim 1, wherein said fascia is received in said second recess when said fascia is attached to said knob.

4. The pull assembly of claim 1, wherein said keyed hole comprises at least one raised ridge between said first notch and said second notch.

5. The pull assembly of claim 4, wherein said raised ridge limits movement of said key tab between said first notch and said second notch when no force is applied.

6. The pull assembly of claim 1, wherein said keyed hole comprises at least one ramp in said overlapping region between a first notch and a second notch.

7. The pull assembly of claim 6, wherein an edge of said ramp limits movement of at least a portion of said key tab from said second notch to said first notch when no additional force is applied.

8. The pull assembly of claim 1, wherein said keyed hole comprises at least one flexible spring wall having a default position when said key tab is not between said first and said second notch.

9. The pull assembly of claim 8, wherein said key tab comprises wings that contact said flexible spring wall when said fascia is between said first notch and said second notch.

10. The pull assembly of claim 9, wherein said flexible wall is biased to move toward said default position after said key tab is rotated into at least one of said first or said second notch.

11. The pull assembly of claim 1, wherein said key tab comprises a post portion extending axially along an axis defined by the knob, and at least one wing portion connected to an end of said post opposite of said fascia, and at least a component of said wing portion extending perpendicularly away from said post.

12. A pull assembly comprising;

a knob having a first recess set within a second recess, said first recess and said second recess being located on an end of said knob;

an insert attachable to said knob, wherein said insert is at least partially within said first recess; and a fascia having a first face and a second face and one of said insert and said fascia comprising a keyed hole, and the other of said insert and said fascia comprising a key tab that is removably interlockable with said keyed hole, wherein said keyed hole has a central circular portion extending an axial length of the keyed hole, a first notch region protruding radially away from said central circular portion, and extending a full axial length of said keyed hole along the central circular portion, a second notch region protruding radially away from said central circular portion, and extending less than 100% of the axial length of the keyed hole along the central portion.

13. The pull assembly of claim 1, wherein said first recess is nested within said second recess.

14. The pull assembly of claim 13, wherein said first recess and said second recess are concentric.

15. The pull assembly of claim 1, wherein rotation of said fascia selectively interlocks the keyed hole and the key tab.

* * * * *